US010024085B2

(12) United States Patent
Burns et al.

(10) Patent No.: US 10,024,085 B2
(45) Date of Patent: Jul. 17, 2018

(54) COMPRESSION MOUNT PADDLE HANDLE

(75) Inventors: Jayden F. Burns, Lime Springs, IA (US); David L. Root, Tripoli, IA (US); Alexander C. Everett, Charles City, IA (US); Jennifer L. Bearman, New Hampton, IA (US)

(73) Assignee: TriMark Corporation, New Hampton, IA (US)

( * ) Notice: Subject to any disclaimer, the term of this patent is extended or adjusted under 35 U.S.C. 154(b) by 270 days.

(21) Appl. No.: 13/549,210

(22) Filed: Jul. 13, 2012

(65) Prior Publication Data

US 2014/0015261 A1 Jan. 16, 2014

(51) Int. Cl.

| | |
|---|---|
| ***E05B 3/00*** | (2006.01) |
| ***E05B 83/44*** | (2014.01) |
| ***E05B 77/34*** | (2014.01) |
| ***E05B 79/06*** | (2014.01) |
| ***E05B 81/00*** | (2014.01) |
| ***E05B 85/12*** | (2014.01) |
| ***E05B 85/14*** | (2014.01) |

(52) U.S. Cl.

CPC ..... *E05B 83/44* (2013.01); *E05B 77/34* (2013.01); *E05B 79/06* (2013.01); *E05B 81/00* (2013.01); *E05B 85/12* (2013.01); *E05B 85/14* (2013.01); *Y10T 292/48* (2015.04); *Y10T 292/57* (2015.04)

(58) Field of Classification Search

CPC .... Y10S 292/31; Y10S 292/30; Y10S 292/22; Y10S 292/23; Y10S 292/61; Y10S 70/20; Y10S 16/19; Y10S 16/25; Y10S 292/27; Y10S 292/46; Y10S 292/53; Y10S 292/57; Y10S 292/60; Y10S 292/64; Y10S 292/65; E05B 85/16; E05B 3/00

USPC ..... 292/1, 307 R, 336.3, 348, DIG. 30, 292/DIG. 31, DIG. 53, DIG. 54, DIG. 64; 16/110.1

See application file for complete search history.

(56) References Cited

U.S. PATENT DOCUMENTS

| | | | | | |
|---|---|---|---|---|---|
| 2,055,688 | A | * | 9/1936 | Halinka | 292/153 |
| 4,846,482 | A | * | 7/1989 | Blodgett et al. | 277/591 |
| 4,875,726 | A | * | 10/1989 | Thau | E05B 79/06 292/337 |
| 5,413,391 | A | * | 5/1995 | Clavin | E05C 1/145 292/170 |
| 5,606,882 | A | | 3/1997 | Larsen et al. | |
| 5,689,980 | A | * | 11/1997 | Weinerman | E05C 1/14 292/170 |
| 6,007,122 | A | | 12/1999 | Linder et al. | |

(Continued)

*Primary Examiner* — Matthieu F Setliff
*Assistant Examiner* — Thomas L Neubauer
(74) *Attorney, Agent, or Firm* — McKee, Voorhees & Sease, PLC

(57) ABSTRACT

A paddle style handle assembly is provided for an RV, emergency vehicle or utility vehicle door or compartment. The assembly includes a housing and pivotal paddle which form a paddle module. The assembly also includes an ornamental bezel. The paddle module and bezel are compression mounted from the interior and exterior sides of a door panel, respectively, so that the panel is sandwiched between the paddle module and the bezel. The housing includes screw holders with molded flash membranes to hold screws prior to assembly on the door panel. The housing includes pockets formed around the paddle axle for receipt of gaskets to inhibit water infiltration. A counterbalance and a power lock actuator may be provided on the paddle module.

14 Claims, 15 Drawing Sheets

(56) References Cited

U.S. PATENT DOCUMENTS

| | | | | |
|---|---|---|---|---|
| 6,010,167 | A | 1/2000 | Tanimoto et al. | |
| 6,059,329 | A | 5/2000 | Spitzley | |
| 6,401,302 | B1 | 6/2002 | Josserand et al. | |
| 6,427,502 | B1 * | 8/2002 | Zagoroff | B62D 33/037 292/336.3 |
| 6,554,331 | B2 | 4/2003 | Ciborowski et al. | |
| 6,612,630 | B1 | 9/2003 | Meinke | |
| 6,708,537 | B1 * | 3/2004 | Eschweiler | E05B 5/00 292/DIG. 27 |
| 7,066,504 | B2 * | 6/2006 | Perkins | 292/300 |
| 7,070,216 | B2 | 7/2006 | von zur Muehlen | |
| 7,341,291 | B2 | 3/2008 | Ooe et al. | |
| 7,407,203 | B2 | 8/2008 | Huizenga et al. | |
| 7,568,744 | B2 | 8/2009 | Tenorio et al. | |
| 7,660,054 | B2 * | 2/2010 | Wagner et al. | 359/820 |
| 7,661,743 | B2 * | 2/2010 | Williamson | E05B 79/06 296/146.1 |
| 7,748,246 | B1 * | 7/2010 | Paige et al. | 70/208 |
| 8,157,301 | B2 | 4/2012 | Sunahara et al. | |
| 8,272,240 | B1 * | 9/2012 | Schilens | E05C 3/042 292/336.3 |
| 8,347,667 | B2 * | 1/2013 | Bacon | E05B 5/00 292/216 |
| 8,876,177 | B2 * | 11/2014 | Takada et al. | 292/336.3 |
| 8,881,564 | B2 * | 11/2014 | Burns et al. | 70/208 |
| 2003/0001399 | A1 * | 1/2003 | Sato | E05B 79/06 292/336.3 |
| 2010/0019455 | A1 * | 1/2010 | Kent et al. | 277/312 |
| 2010/0090489 | A1 * | 4/2010 | Carnevali | 296/24.34 |
| 2012/0260700 | A1 * | 10/2012 | Matre | 70/91 |
| 2012/0274457 | A1 * | 11/2012 | Burns et al. | 340/425.5 |

* cited by examiner

COMPRESSION MOUNT PADDLE HANDLE

BACKGROUND OF THE INVENTION

Paddle style handle assemblies for recreational vehicles, emergency vehicles, utility vehicles, and similar doors and compartments are well known. Conventional handle assemblies include a housing with a pivotal paddle mounted thereon, with the housing and paddle being installed in a hole or cutout in the door from the front or exterior of the door. This construction requires the housing and associated brackets and pivot plates to be rotated and turned to fit through the handle opening of the door panel, and then secured to the door via screws extending from the back or inside of the door. This installation of prior art handle assemblies is awkward and time consuming, and therefore adds to the overall cost of the vehicle.

Therefore, a primary objective of the present invention is the provision of an improved handle assembly for doors and compartments in recreational vehicles, emergency vehicles, utility vehicles, and the like.

A further objective of the present invention is the provision of a two piece compression mount door handle assembly.

A further objective of the present invention is the provision of a two-piece paddle handle assembly wherein the housing and paddle are installed from the back of the door panel or skin.

Still another objective of the present invention is the provision of a two piece paddle handle assembly having an exterior bezel and an interior housing which are installed in a door opening via a compression mount.

Yet another objective of the present invention is the provision of an improved two-piece paddle housing assembly which allows for quick and easy change out of an exterior trim piece.

Still another objective of the present invention is the provision of an improved two-piece paddle-style door handle with screw holes having molded flash to hold screws in place for faster installation of the handle to a door.

Another objective of the present invention is the provision of an improved handle assembly having a housing with axle holes for pivotal paddle, with molded pockets around the axle holes to receive gaskets to reduce water infiltration.

Yet another objective of the present invention is the provision of a two piece handle assembly having an escutcheon with a recessed pocket for retaining a gasket to minimize moisture migration.

A further objective of the present invention is the provision of an improved paddle handle assembly having a counterbalance weight for entrance door applications to meet Federal Motor Vehicle Safety Standard 206 for Door locks and door retention components for Passenger Cars, Multipurpose Passenger Vehicles, and Trucks.

Another objective of the present invention is the provision of an improved door handle which can be easily connected to a power actuator for power locking and unlocking.

A further objective of the present invention is the provision of an improved paddle style door handle assembly which is economical to manufacture, and durable and safe in use.

These and other objectives will become apparent from the following description of the invention.

SUMMARY OF THE INVENTION

The handle assembly of the present invention has a two piece construction for quick and easy mounting on the door or compartment of an RV, emergency vehicle or utility vehicle. The handle includes a paddle module comprising a housing with a paddle pivotally mounted therein for actuating the door latch. The paddle module is installed from the back or interior side of the door panel or skin. A decorative bezel is installed from the front or exterior side of the door panel. The housing and bezel are compression fit on opposite sides of the door panel using screws extending from the interior side of the panel. A thin flash membrane or ridge is diecast across the screw holes in the housing so that the screws can be pushed through the membrane or ridge prior to installation and thereby hold the screws and thereby minimize installation time. The rear side of the bezel has a perimeter gasket to inhibit moisture migration between the bezel and the door panel. The axle holes in the housing for the pivotal paddle include molded pockets for receiving gaskets to reduce and inhibit water infiltration through the axle holes. An escutcheon on the housing also includes a diecast recess to receive a gasket to preclude or reduce moisture penetration. A counterbalance is provided on the rear of the housing. A power locking actuator can be quickly and easily added to the paddle module for power locking and unlocking of the door lock.

DETAILED DESCRIPTION OF THE DRAWINGS

Figure 4:
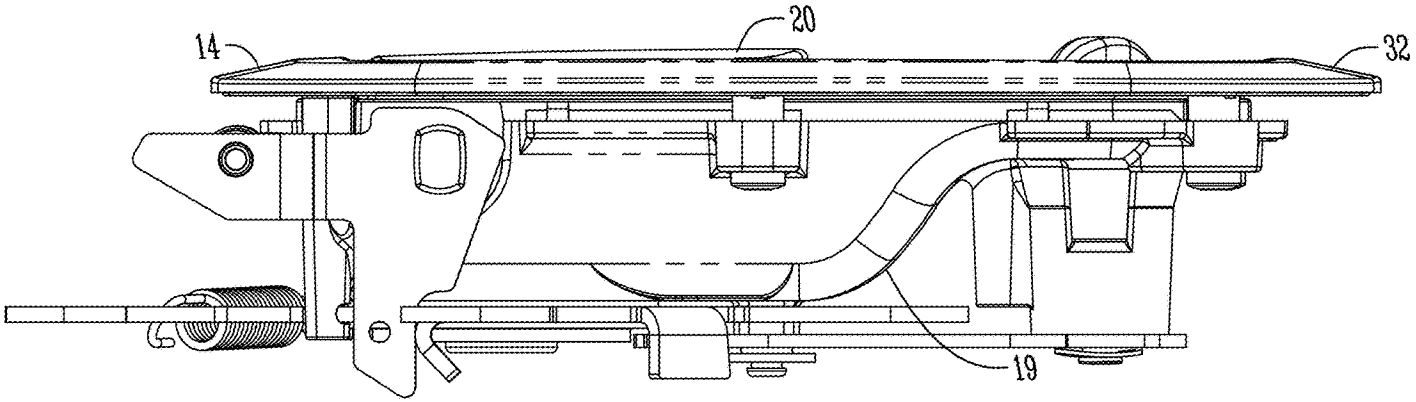
FIG. 4 is a side elevation view of the assembly.
Figure 5:
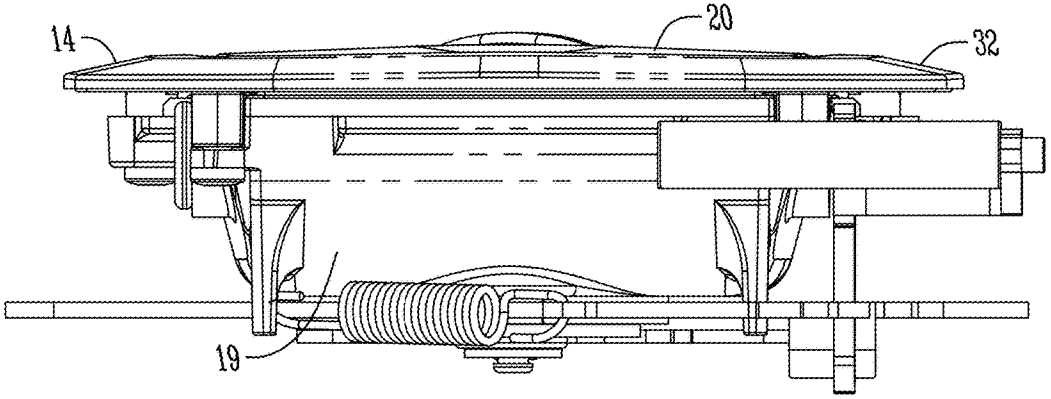
FIG. 5 is an end elevation view of the assembly.
Figure 6:
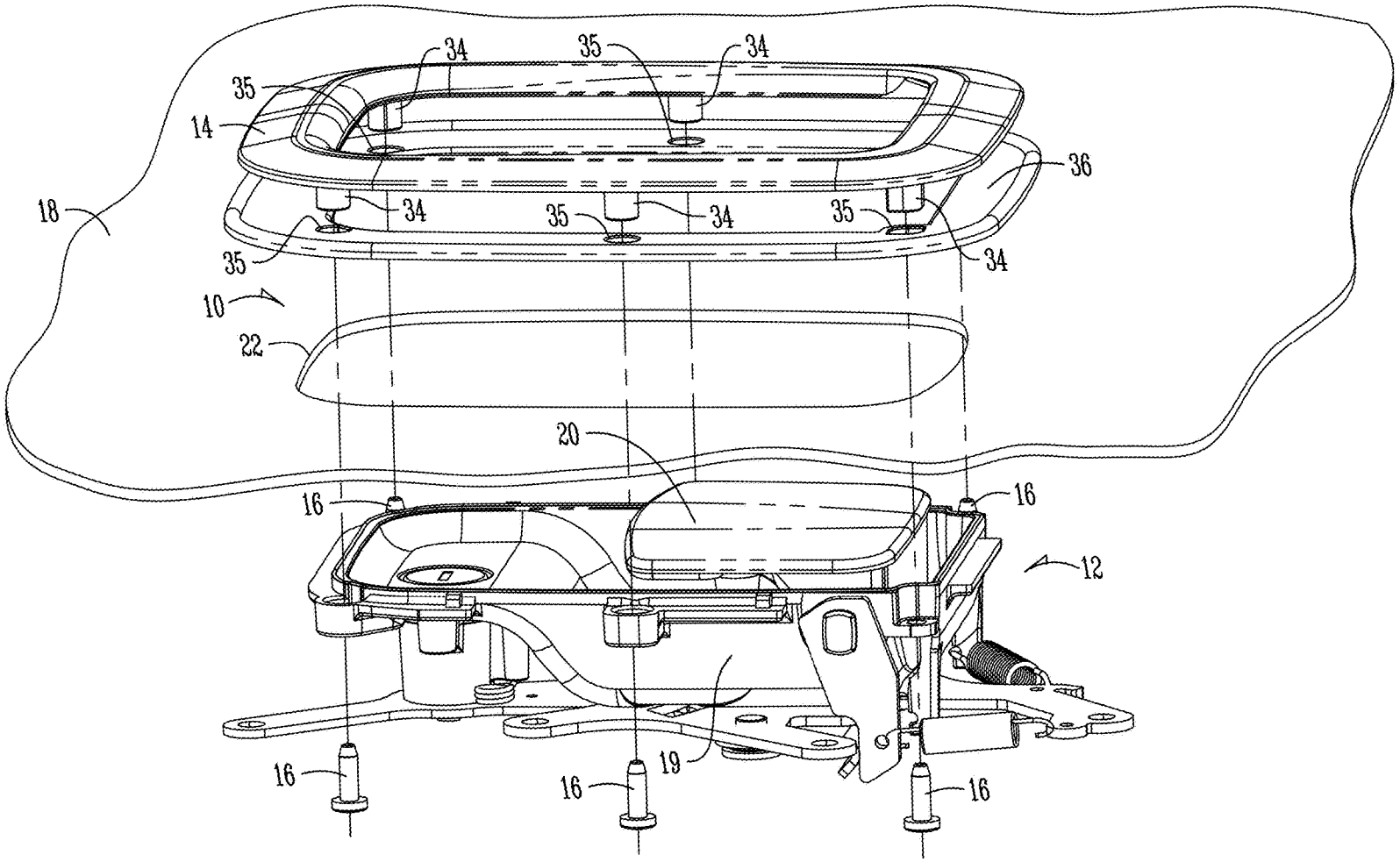
FIG. 6 is a partially exploded view of the door handle assembly.

The handle assembly of the present invention is generally designated by the reference numeral 10 in the drawings. The handle assembly 10 includes two primary components, the paddle module 12 and bezel 14. As best seen in FIG. 4, the bezel 14 is adapted to be attached to the paddle module 12 via a plurality of screws 16. The paddle module 12 is installed from the interior or back side of the door panel 18, while the bezel 14 is installed from the exterior or front side of the door panel 18.

The paddle module 12 includes a housing 19 having a pivotal handle 20 which extends through an opening 22 in the door panel 18 for actuation by a person on the outside of the door. The paddle 20 can be grasped by the fingers of a person and pulled outwardly to release or disengage the door latch when the handle assembly 10 is not locked. The paddle 20 is spring biased so as to return to a neutral position, as shown in the drawings, when the paddle 20 is released by a person. The paddle 20 and the associated linkage arms 24, 26 on the rear of the housing 12 may have a free float connection wherein the paddle 20 will pivot or pull outwardly even when the door lock is in a locked position, or alternatively, may be a non-free float or locked rigid connection so that the paddle 20 is fixed against movement when the door lock is locked.

The housing 19 includes a plurality of bosses or screw holders 28 spaced along the perimeter edge of the housing 19. Preferably, the housing 19 is diecast zinc. During the casting process, a thin zinc ridge or flash 30 extends across each screw holder 28. Prior to installation of the handle assembly 10 on the door panel 18, the screws 16 can be pressed through the thin flash 30 for retention in the screw holders 28. This ability to retain the screws 16 and the screw holes 28 expedites the assembly time for the paddle model 12 and bezel 14 and eliminates problems of dropped screws.

Figure 18:
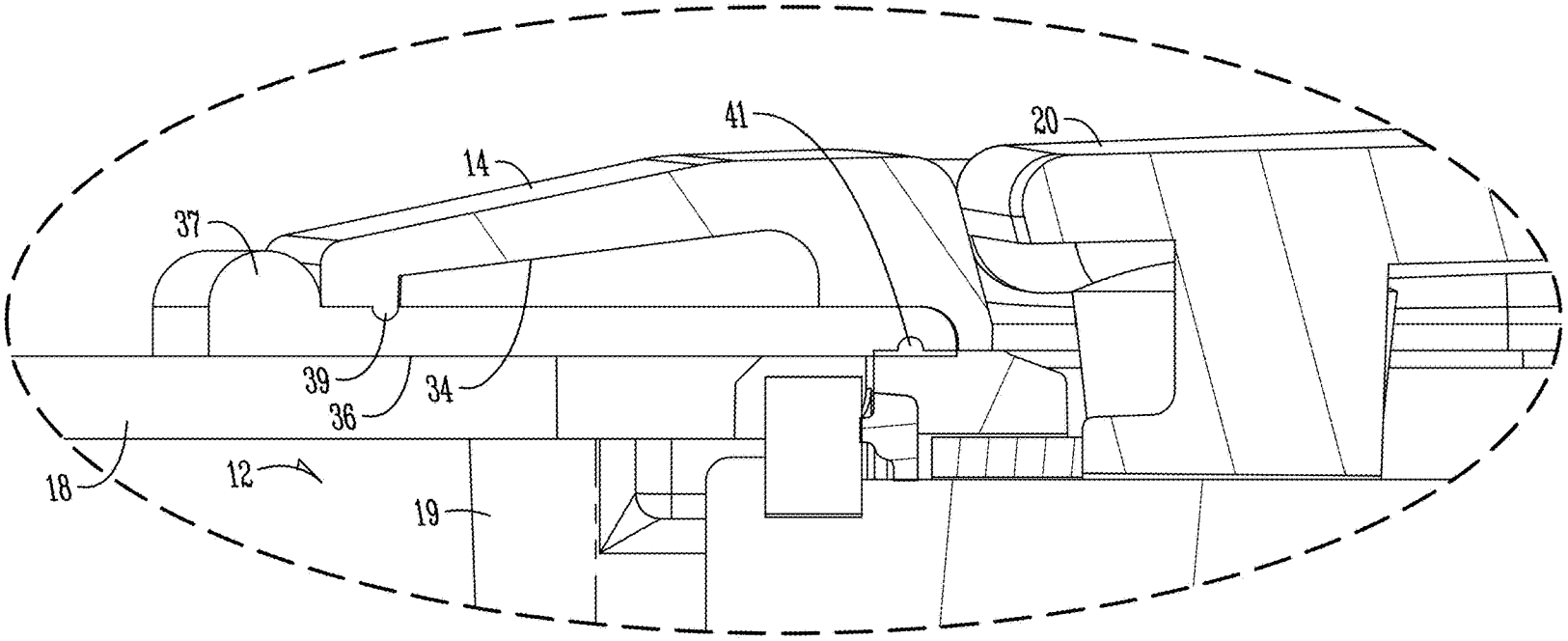
FIG. 18 is an enlarged partial sectional view of the bezel, sealing gasket, and paddle module mounted on a door panel taken along lines 18-18 of FIG. 16.

The bezel 14 includes a decorative front surface 32 and a plurality of bosses 34 formed on the rear or backside of the bezel 14 during the bezel molding, process. The bosses 34 extend through holes 35 in a gasket 36 so as to form an integrated unit or assembly prior to installation of the housing 12 and bezel 14 on the door panel 18. This integration of the bezel 12 and gasket 36 expedites the assembly process by eliminating the need to handle two separate components on the front or exterior side of the door panel 18 during installation of the handle assembly 10. The gasket 36 resides between the bezel 14 and the front surface of the door panel 18 so as to prevent or inhibit moisture migration between the bezel 14 and the door panel 18. The gasket has an outer perimeter bead 37 which extends around the bezel 14. The bezel also has a molded rib 39 on the back side to engage the gasket 36. The housing also has a rib 41 to enhance the seal of the gasket 36, as seen in FIG. 18. The gasket 36 also seals between the bezel flange and the paddle housing 12. The extended edge of the bezel 14 also provides coverage of the paddle gap.

Figure 9:
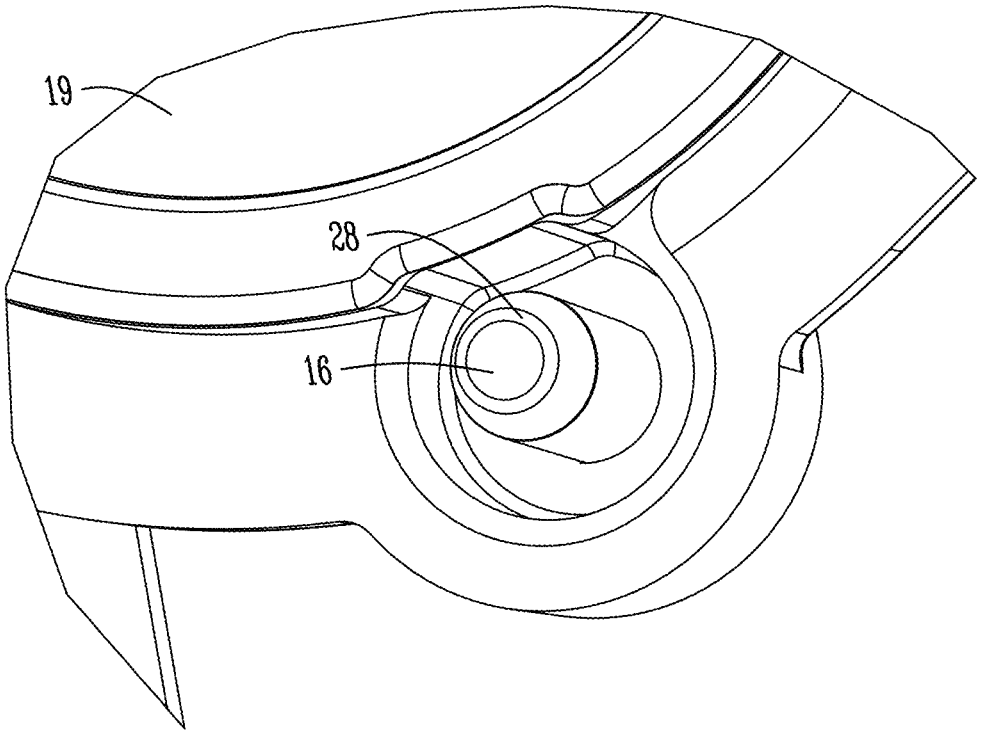
FIG. 9 is an enlarged view taken along line 9-9 of FIG. 8.

The paddle 20 is pivotally mounted to the housing 19 by an axle 38 extending through holes in opposite sides 40 of the housing 19 and through spaced apart legs 42 on the paddle 20, as best seen in FIG. 9. A pocket 44 is formed in each of the housing axle holes, with a gasket 46 mounted in each pocket 44. These axle gaskets 46 inhibit water infiltration through the axle holes of the housing 19. Preferably, axle bushings 47 are used on the housing 19, as in the prior art.

Figure 1:
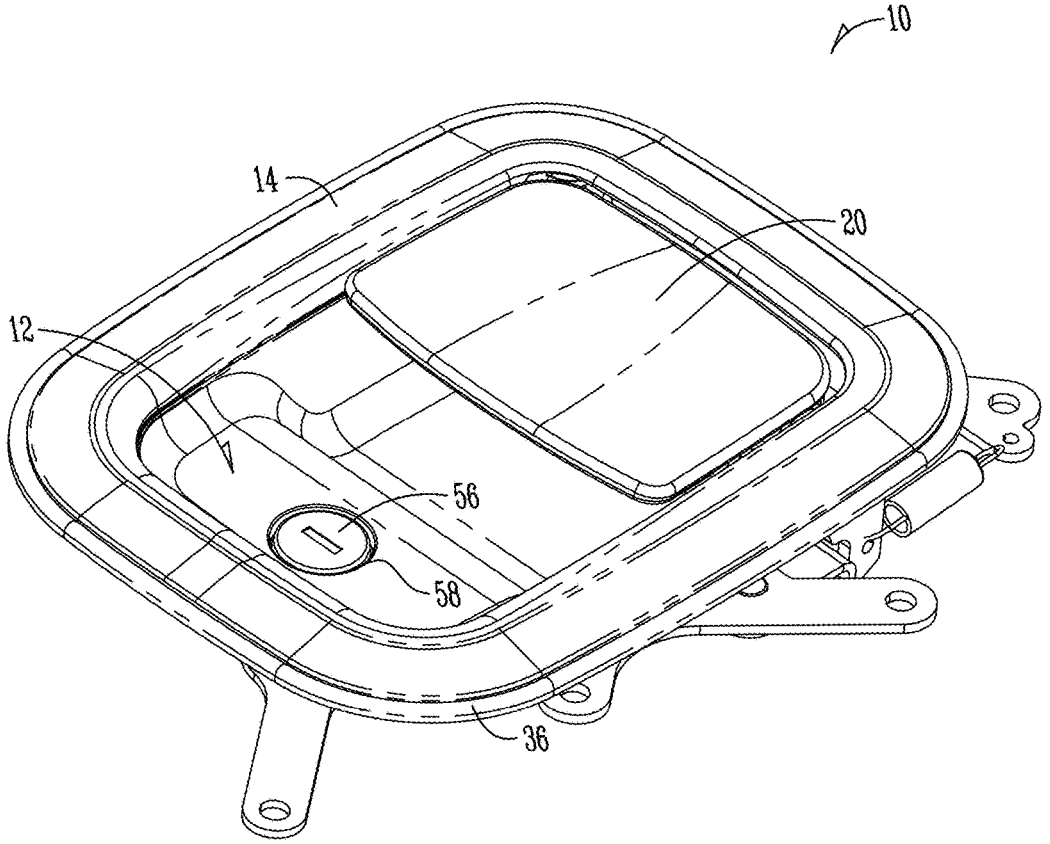
FIG. 1 is a perspective view of the exterior door handle assembly of the present invention with a key lock option.
Figure 2:
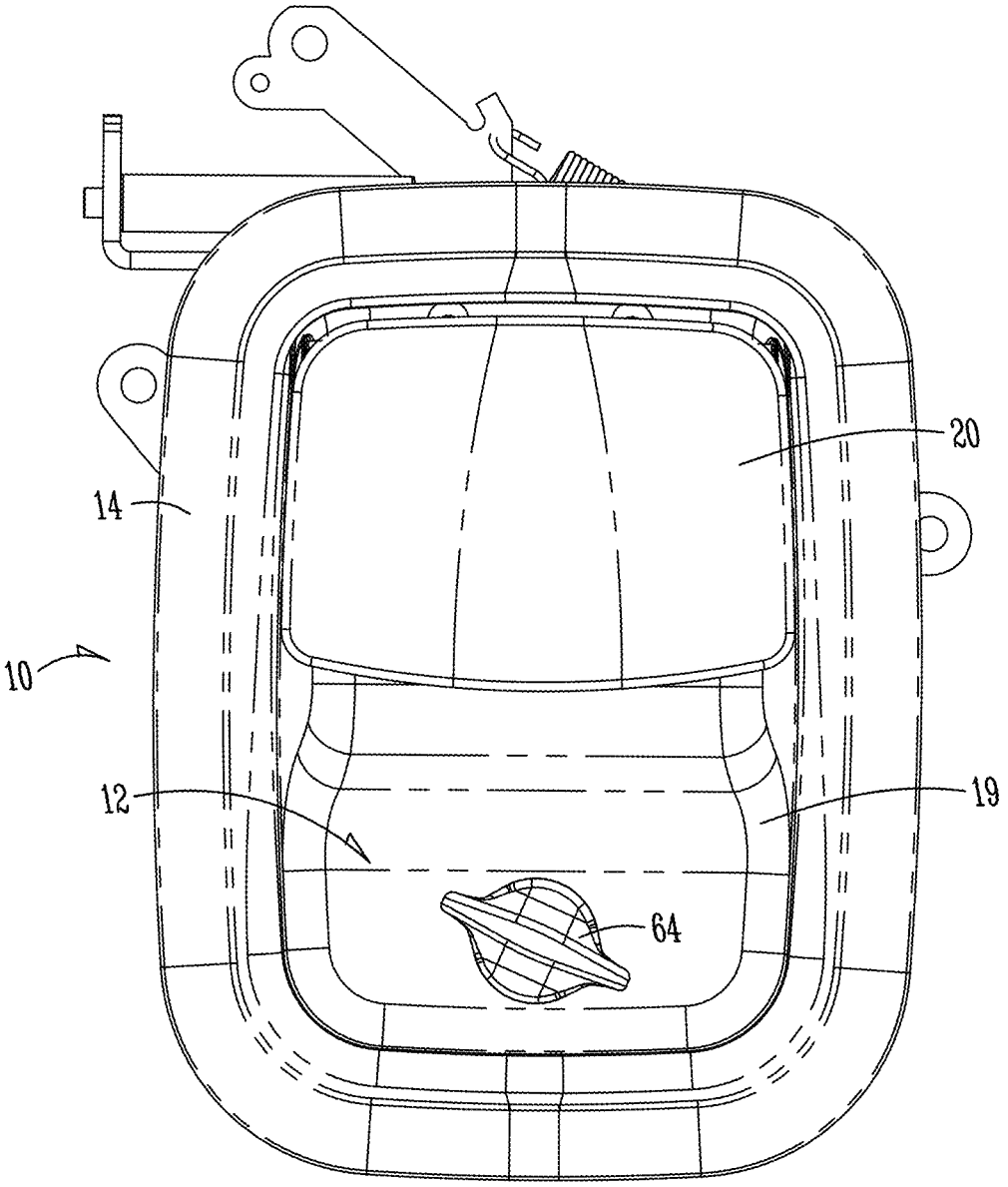
FIG. 2 is a plan view of the door handle of the present invention with an inside locking knob option.
Figure 3:
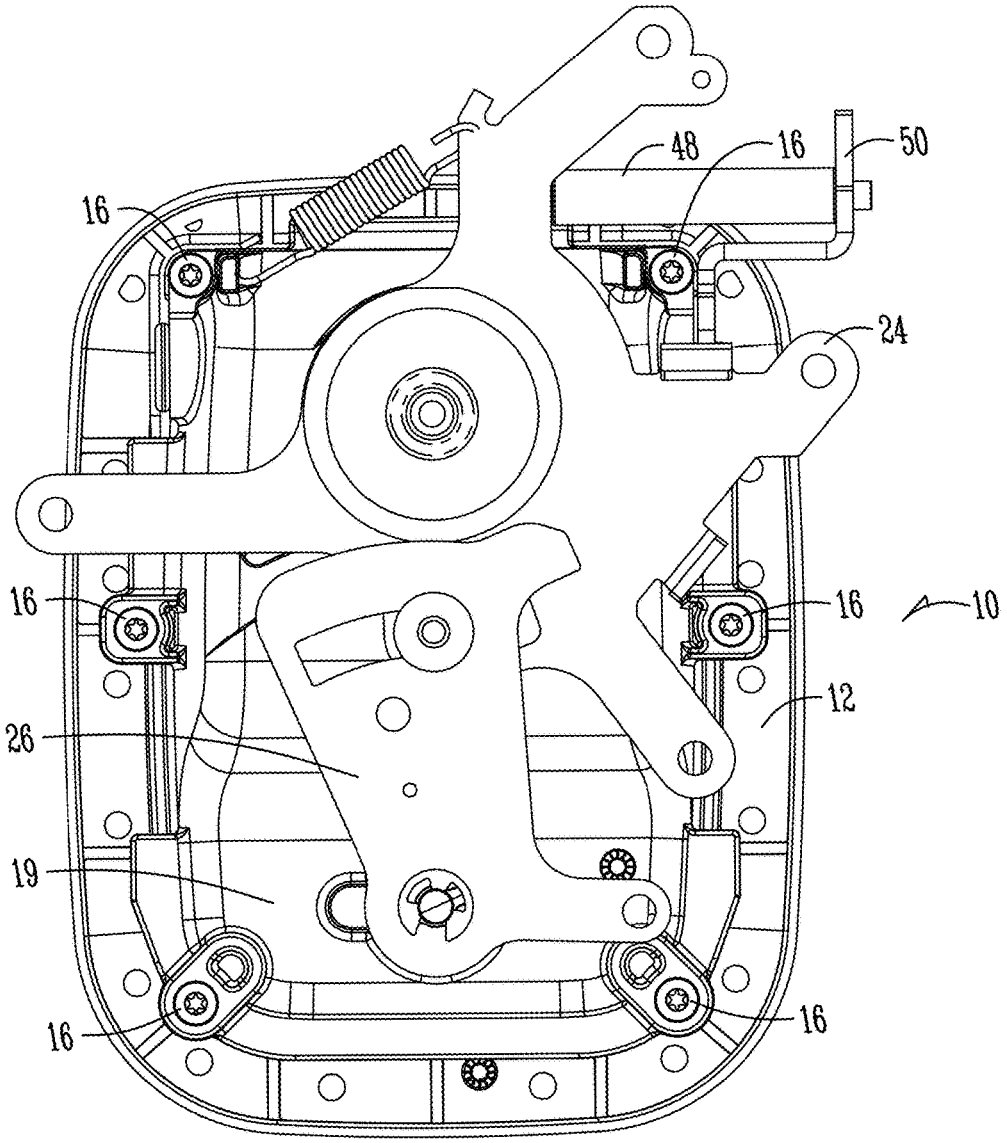
FIG. 3 is a rear plan view of the door handle assembly of FIG. 2.

The housing 19 of the handle module 12 is also provided with a counterbalance or weight 48 so as to comply with the National Highway and Traffic Safety Association Regulations, when necessary. The counterweight 48 is supported on the housing 12 by brackets 50, as seen in FIG. 3, or in any other convenient manner. For example, the counterbalance 48 may be a 30G for FMVSS 206 entrance door applications.

The handle assembly 10 is also adapted to be quickly and easily connected to a power actuator 52 so as to provide power locking and unlocking of the associated door lock. As seen in FIGS. 7, 8, 12, and 13, a mounting bracket or other hardware 54 is fixed on the rear of the housing 19, with the power actuator 52 being fixed or fastened to the brackets 54. The power actuator 52 may be provided as original equipment on the handle assembly 10, or may be retrofit thereto. Thus, a handle assembly with the power actuator 52 can be remotely locked and unlocked.

When the handle assembly 10 is used as an exterior door handle, the paddle module 12 may be provided with a key cylinder 56 mounted in a recess 58 molded in the housing 19. When the handle assembly 10 is used as an interior handle, a knob 64 is provided on the paddle module for locking and unlocking the assembly 10.

The bezel 14 can be selected from multiple bezels having different colors, finishes, and ornamental designs, so as to allow an individual customer to customize the exterior appearance of the handle assembly 10. Thus, the design and configuration of the paddle module 12 can remain constant while the design and appearance of the bezel 14 can be selectively interchanged.

Figure 7:
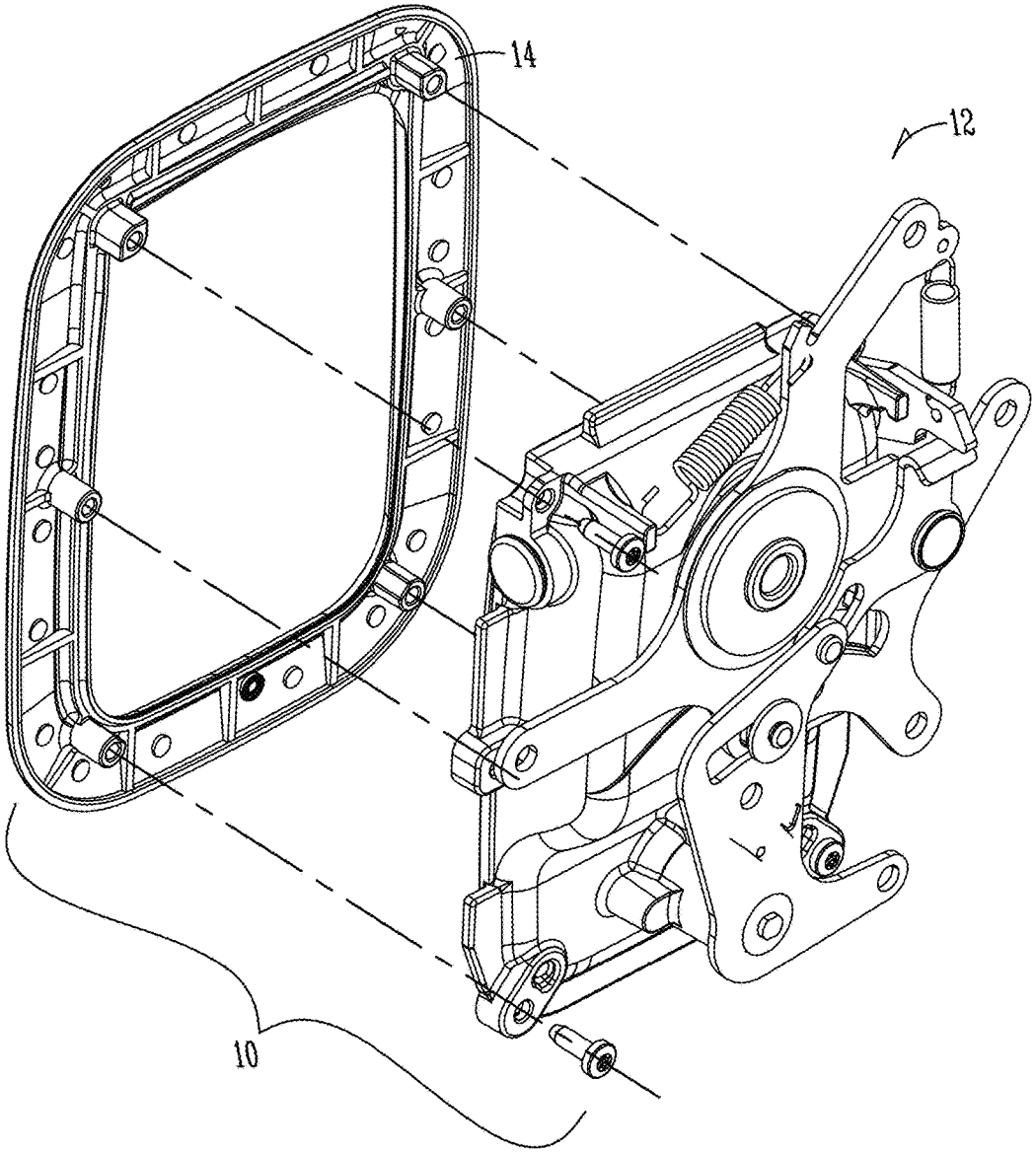
FIG. 7 is another exploded view of the assembly, without the bezel gasket for clarity.
Figure 8:
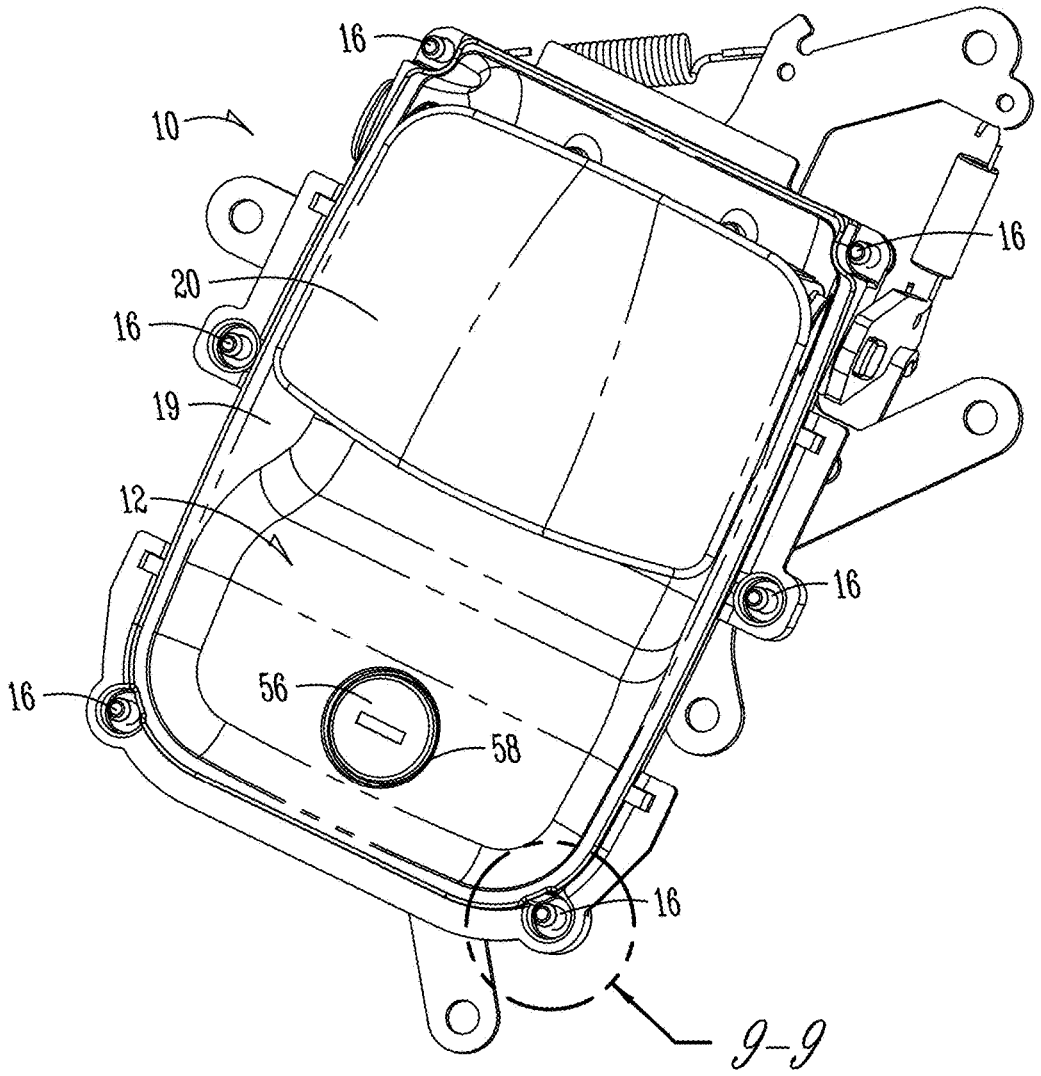
FIG. 8 is a perspective view of the handle housing and paddle without the bezel attached thereto.
Figure 11:
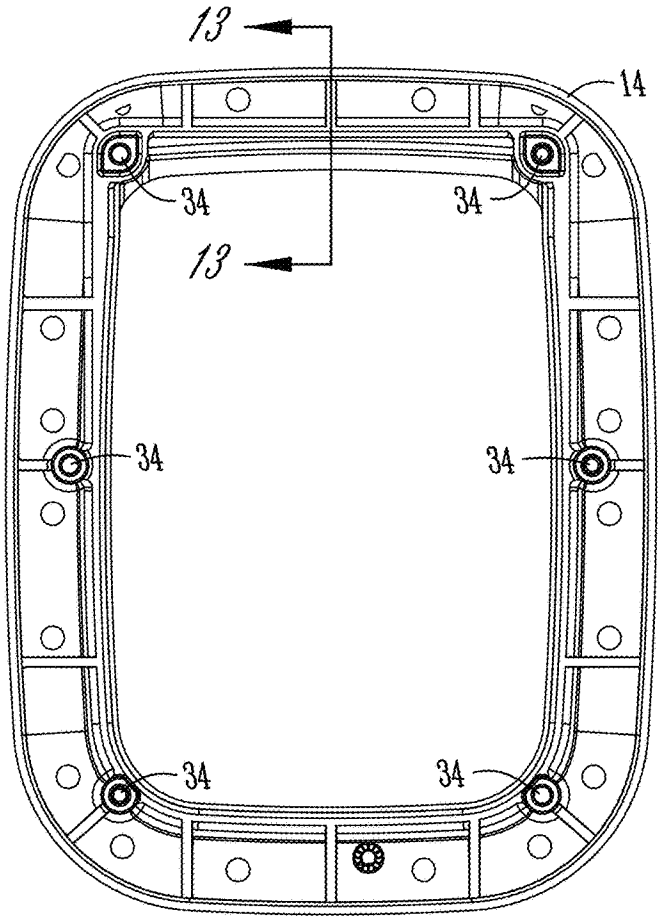
FIG. 11 is a rear plan view of the bezel.
Figure 10:
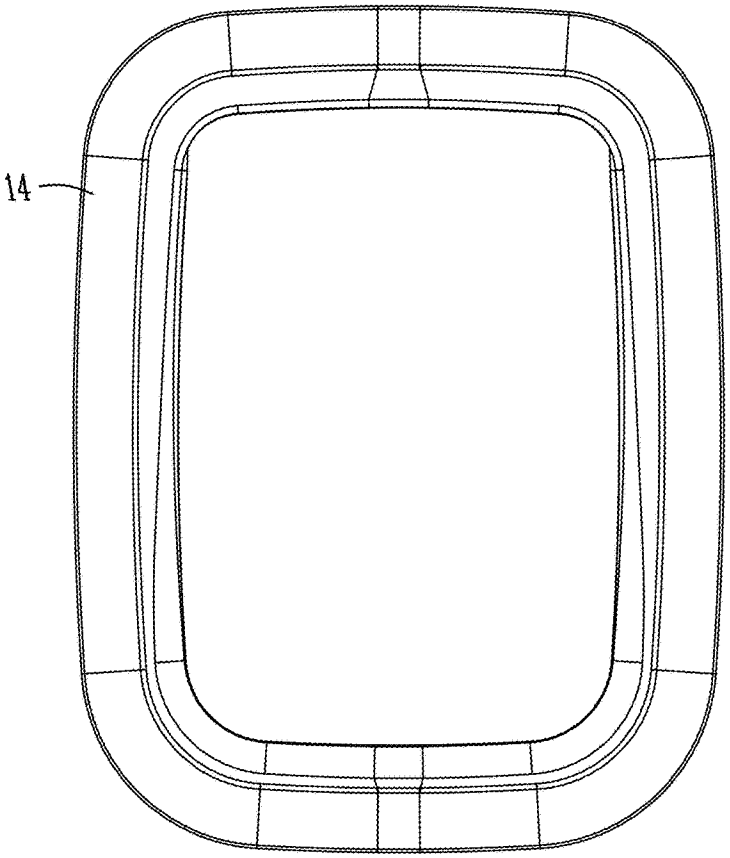
FIG. 10 is a front plan view of the bezel.
Figure 12:
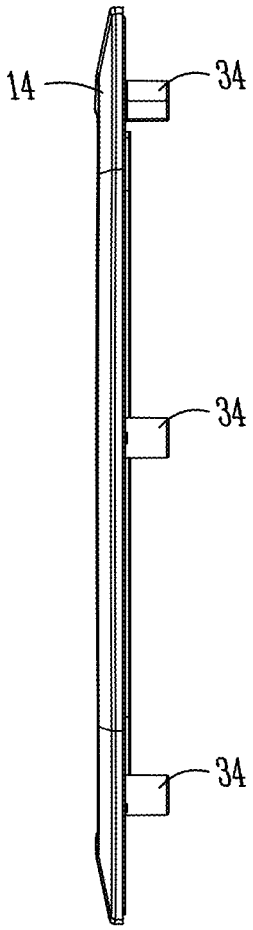
FIG. 12 is a side elevation view of the bezel.
Figure 13:
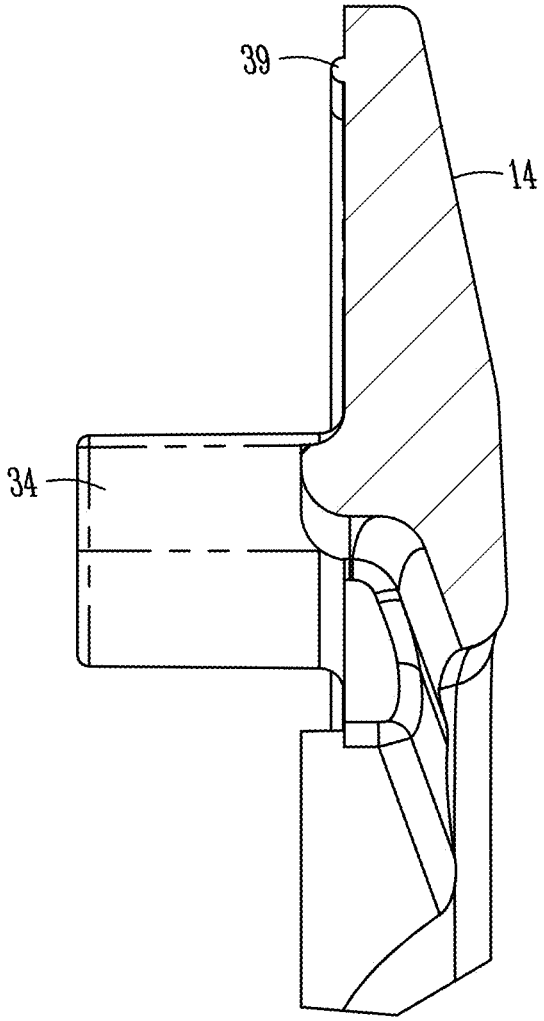
FIG. 13 is an enlarged sectional view of the bezel taken along lines 13-13 of FIG. 11.
Figure 14:
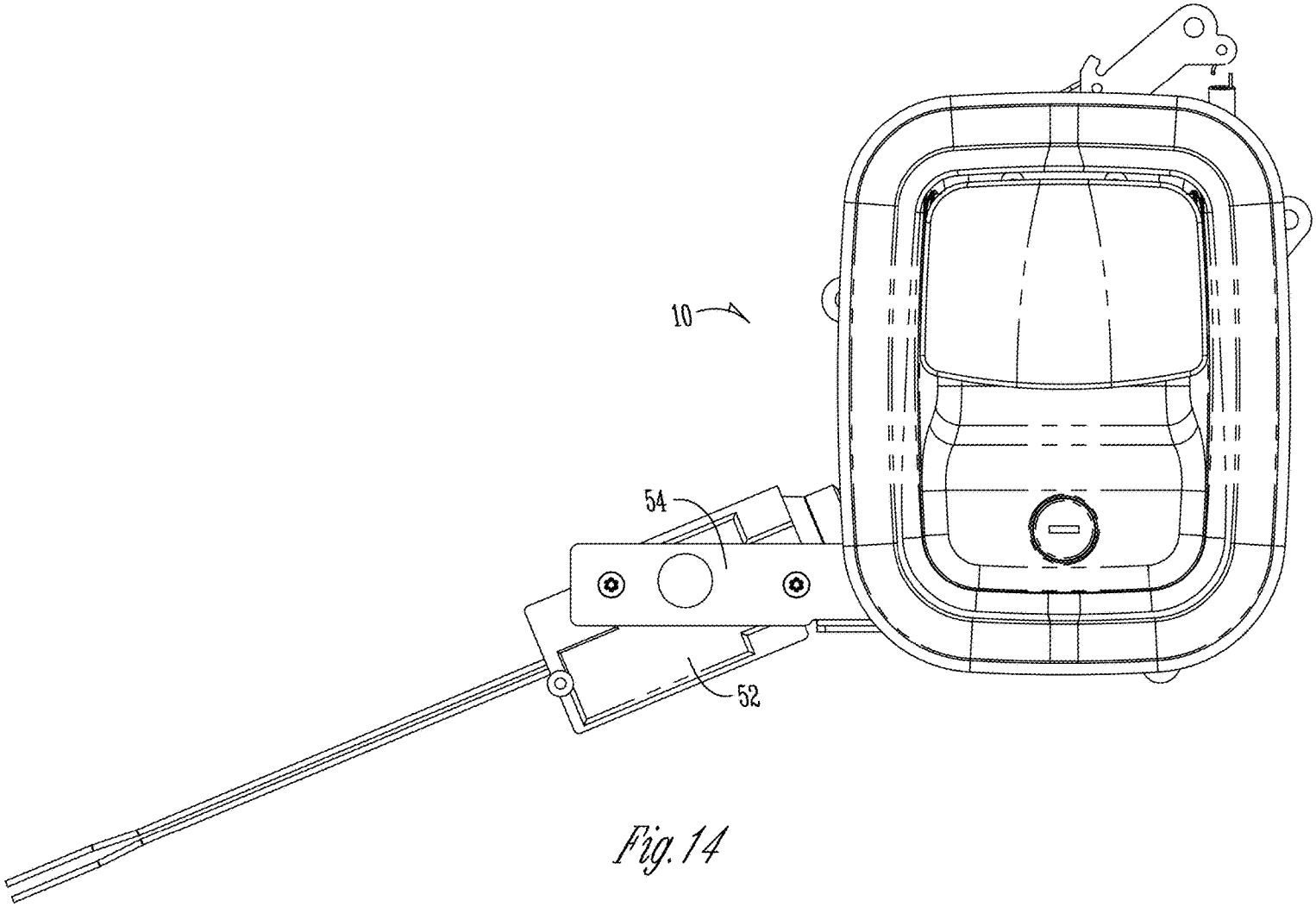
FIG. 14 is a front plan view of the handle assembly with a power lock actuator mounted thereto.
Figure 15:
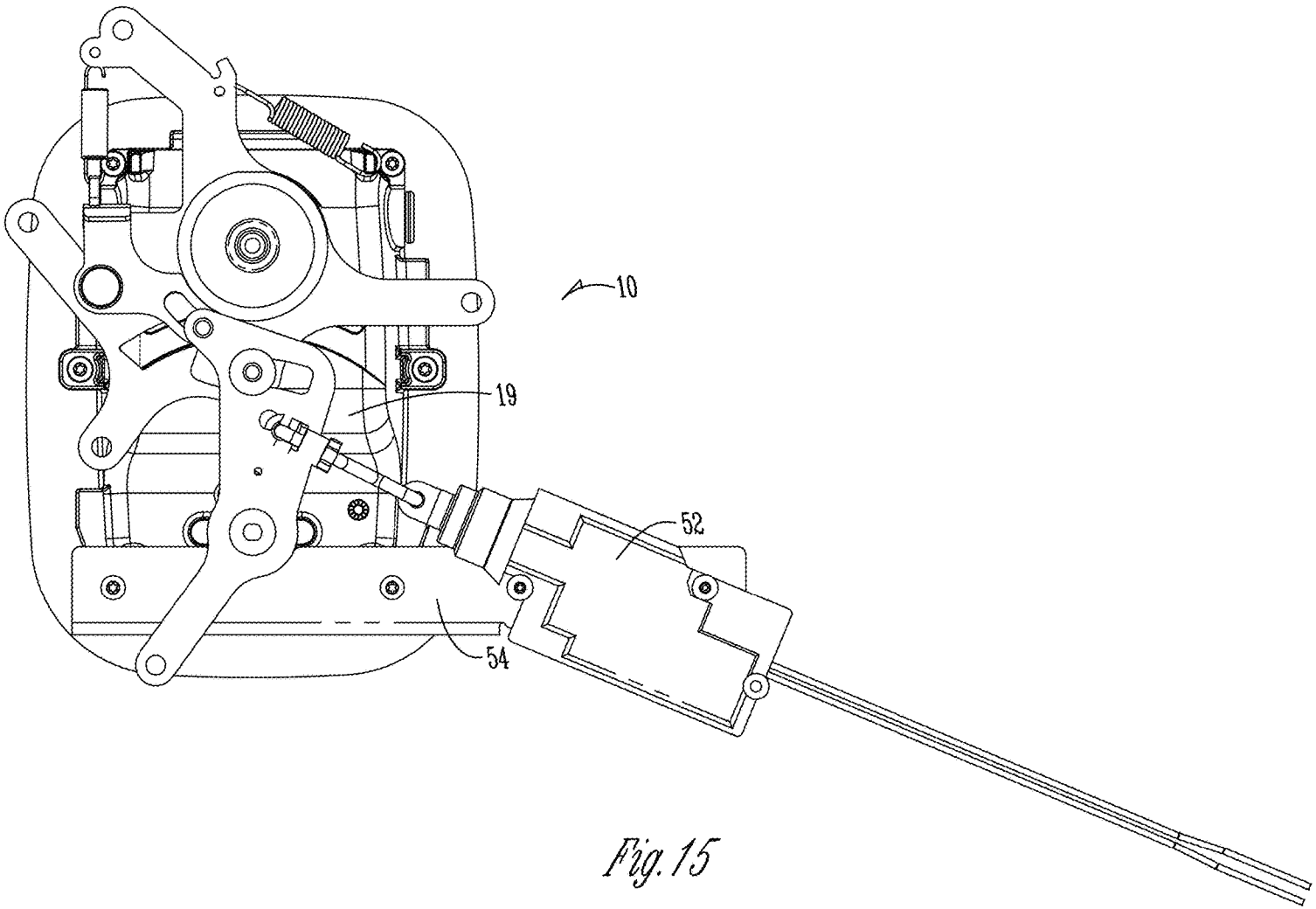
FIG. 15 is a rear plan view of the paddle assembly with a power lock actuator attached thereto.
Figure 16:
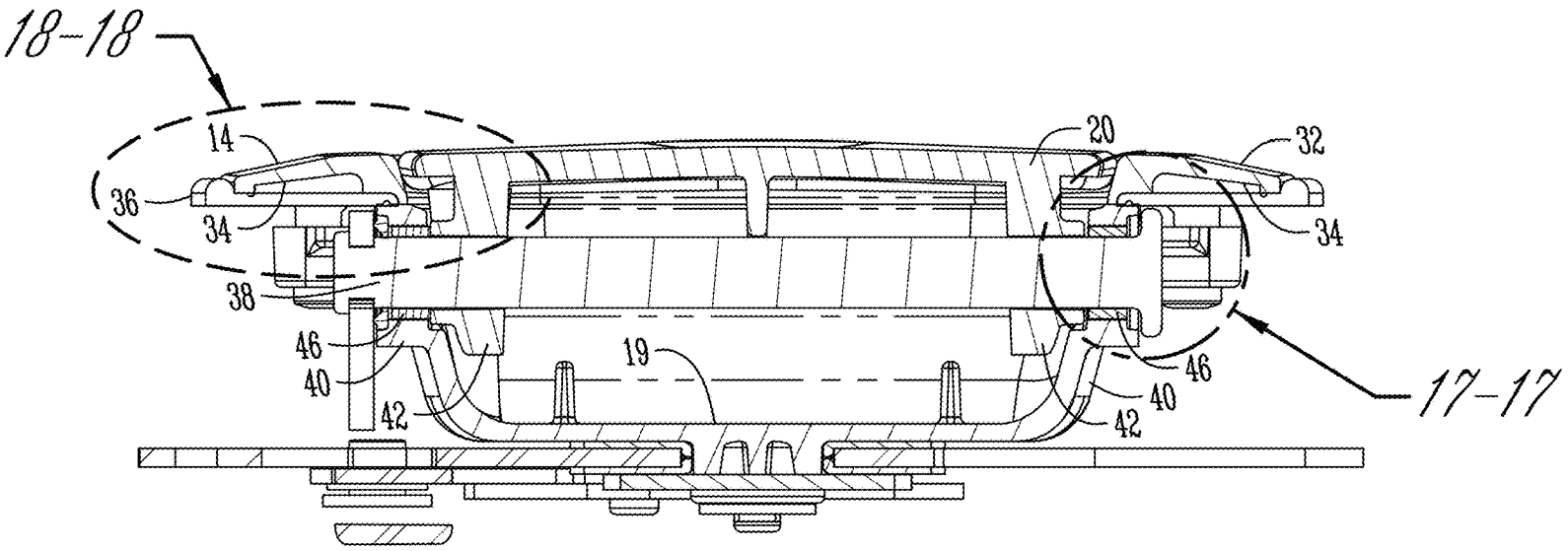
FIG. 16 is a sectional view of the handle assembly.
Figure 17:
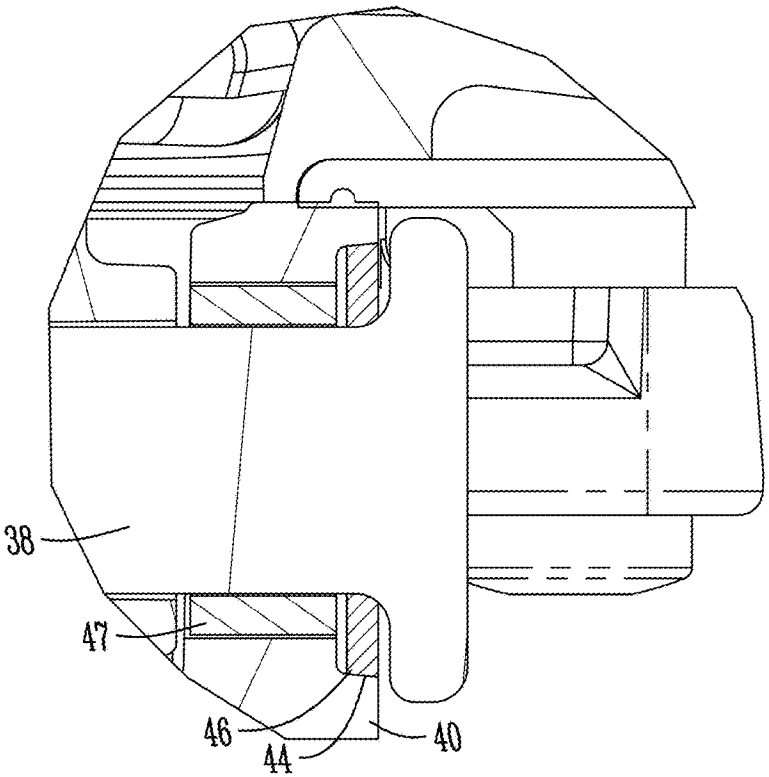
FIG. 17 is an enlarged view taken along lines 10-10 of FIG. 16.

The bezel 14 and housing 12 are keyed so as to assemble in only one orientation. More particularly, the bosses 28 at the upper and lower ends of the housing have different shapes, as do the bosses 34 on the upper and lower ends of the bezel 14, as seen in FIGS. 7, 8, 11. Thus, the housing 12 and bezel 14 only fit together in one configuration, which simplifies the assembly process.

The two piece compression assembly of the paddle module 12 and bezel 14 provides for easier installation on the door panel 18, and provides better clamping force between the paddle module 12 and the bezel 14 so as to inhibit water infiltration through the opening of the door panel 18.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A handle assembly for a vehicle door having a door panel with opposite interior and exterior sides, and the panel having an opening, the handle assembly comprising:

a paddle housing mountable on the interior side of the door panel, and having a recessed well;

a paddle pivotally mounted on the housing and extending outwardly through the panel opening so as to be actuable from the exterior side of the panel;

a ring-shaped exterior trim bezel mountable on the exterior side of the panel and extending around the panel opening, so as to sandwich the panel between the paddle housing and the trim bezel and having an open area through which a user can insert their fingers into the well to pull the paddle;

the bezel having opposite front and back sides, and the bezel having a plurality of bosses; and a gasket having holes through which the bosses extend for mounting the gasket on the back side of the bezel, with the bezel engaging a front surface of the gasket.

2. The handle assembly of claim 1 wherein the gasket has a perimeter bead extending outwardly beyond and around the bezel.

3. The handle assembly of claim 1 wherein the paddle housing has a perimeter rib for sealing with a back surface of the gasket.

4. The handle assembly of claim 1 further comprising a plurality of screws extending through the paddle housing and the door panel into the bezel to secure the paddle housing to the bezel.

5. The handle assembly of claim 1 wherein the paddle housing includes an axle extending through the housing, with the paddle being mounted on the axle.

6. The handle assembly of claim 5 wherein the housing includes opposite axle holes with a pocket surrounding each hole, and a gasket in each pocket to inhibit water infiltration.

7. The handle assembly of claim 1 further comprising a counterbalance on the paddle housing.

8. The handle assembly of claim 1 further comprising a power actuator attached to the paddle housing.

9. The handle assembly of claim 1 wherein the paddle housing includes a bracket rigidly mounted on the housing, and the power actuator is fixed to the bracket.

10. The improved handle assembly of claim 1 wherein the trim bezel has a rib to engage a front surface of the gasket.

11. The improved handle assembly of claim 1 wherein the paddle housing has a rib to engage a rear surface of the gasket.

12. The handle assembly of claim 1 wherein the gasket engages the bezel, the door panel, and the paddle housing.

13. The improved handle assembly of claim 1 wherein the trim bezel has a rib to engage a front surface of the gasket, and the paddle housing has a rib to engage a rear surface of the gasket.

14. The improved handle assembly of claim 12 wherein the trim bezel has a rib to engage a front surface of the gasket, and the paddle housing has a rib to engage a rear surface of the gasket.

* * * * *